US008190072B2

(12) United States Patent
Wada et al.

(10) Patent No.: US 8,190,072 B2
(45) Date of Patent: May 29, 2012

(54) DEVELOPING DEVICE AND IMAGE FORMING APPARATUS HAVING THE SAME

(75) Inventors: Minoru Wada, Osaka (JP); Taisuke Nagao, Osaka (JP); Hisashi Mukataka, Osaka (JP); Seishi Ojima, Osaka (JP)

(73) Assignee: Kyocera Mita Corporation (JP)

( * ) Notice: Subject to any disclaimer, the term of this patent is extended or adjusted under 35 U.S.C. 154(b) by 311 days.

(21) Appl. No.: 12/501,536

(22) Filed: Jul. 13, 2009

(65) Prior Publication Data

US 2010/0014879 A1 Jan. 21, 2010

(30) Foreign Application Priority Data

Jul. 17, 2008 (JP) ..... 2008-185649

(51) Int. Cl.
*G03G 15/09* (2006.01)

(52) U.S. Cl. ..... 399/274; 399/259; 399/264; 399/275; 399/284

(58) Field of Classification Search ..... 399/259, 399/264, 274, 275, 284
See application file for complete search history.

(56) References Cited

U.S. PATENT DOCUMENTS 4,876,574 A * 10/1989 Tajima et al. ..... 399/275
2008/0124132 A1* 5/2008 Aimoto ..... 399/256

FOREIGN PATENT DOCUMENTS

JP 2-179662 7/1990
JP 2003-021961 1/2003
JP 2007279588 A * 10/2007

OTHER PUBLICATIONS

English Abstract, JP 2007279588 A to Baba et al.*

* cited by examiner

*Primary Examiner* — Ryan Walsh
(74) *Attorney, Agent, or Firm* — Gerald E. Hespos; Michael J. Porco

(57) ABSTRACT

A developing device includes a container storing a two-component developer including a toner and a carrier, a toner carrying body carrying the toner in the container and supplying the toner to a predetermined image carrying body by rotation, a restricting member held in press contact with the toner carrying body, and a restricting nip section formed between the toner carrying body and the restricting member. The restricting nip section selects only the toner in the two-component developer to form a uniform toner layer on the toner carrying body.

16 Claims, 8 Drawing Sheets

DEVELOPING DEVICE AND IMAGE FORMING APPARATUS HAVING THE SAME

BACKGROUND OF THE INVENTION

1. Field of the Invention

The present invention relates to a developing device used in an image forming apparatus that employs an electrophotographic process, such as a copying machine, printer or facsimile machine, and more particularly, to a developing device which uses a two-component developer including a toner and a carrier, and an image forming apparatus having the same.

2. Description of the Related Art

A two-component development system which uses a toner and a carrier as a developer, or a one-component development system which uses only a toner and no carrier are known as methods for a developing device employed in an image forming apparatus based on an electrophotographic method, such as a copying machine, a printer, a facsimile machine, or a composite machine combining these.

In a developing device based on a one-component development system, toner accommodated inside the main body of an apparatus is supplied to the surface of a developing roller by means of a supply roller, and a restricting member is pressed in contact with the developing roller, thereby restricting the amount of toner as well as applying electric charge by friction. Next, by rotating the developing roller and guiding the toner to a development region opposing an image carrying body, an electrostatic latent image which has been formed on the image carrying body is developed. When the toner left on the surface of the developing roller has been returned to the apparatus by passing a sealing member and has been removed from the surface of the developing roller by the supply roller, new toner is supplied to the developing roller. A developing device based on a one-component development system is beneficial in terms of providing a compact developing device at low cost.

A one-component development system of this kind is suitable for improving image quality since there is no disturbance of the electrostatic latent image on the image carrying body by a magnetic brush. However, if a system is adopted in which additional toner can be replenished in order to achieve long life of the developing device, then due to the effects of sorting of the toner particle size and degradation of the toner, or the like, which occurs inside the developing device, a difference in properties arises between newly replenished toner and residual toner inside the developing device. Due to this difference in properties, toner charging defects (charging non-uniformities) become liable to occur when the toner is charged by the restricting member, and there has been a risk that this will lead to decline in image quality due to image fogging, density non-uniformities, and like.

On the other hand, systems proposed as a development system enabling increased life span include a two-component development system which is able to maintain a stable amount of charge for a long period of time and is suitable for achieving long life span of the toner, and a so-called touch-down development system such as that disclosed in Japanese Laid-open Patent Application No. 2003-21961. A touch-down development system employs a two-component development system such as that described above in a toner charging region, with a view to increasing the life of the toner, and in the subsequent development region, employs a one-component development system which propels toner only onto a photosensitive body by a non-contact method, with the object of achieving high image quality. Consequently, such a system is able to utilize the respective benefits of both the one-component development system and the two-component development system. However, with a two-component development system and a touch-down development system, there are limitations on the size reduction and cost reduction of the developing device.

As a method of stabilizing the charge on the toner similarly to a two-component development system, while using a one-component development system, Japanese Laid-open Patent Application No. 2-179662, for example, discloses a developing device which mixes a developer and charge assisting particles which assist charging of the toner in a developer cartridge and supplies previously charged toner only to a developing sleeve via a mesh disposed in an opening section of the developer cartridge.

However, in the method described in Japanese Laid-open Patent Application No. 2-179662, since charge assisting particles are introduced into the developer cartridge, then there are problems in that the cost of consumables increases, and the fact that the ratio between the toner and the charge assisting particles changes and the amount of charge of the toner changes, as the toner is consumed. Furthermore, there is also a problem in that depending on the particle size distribution of the charge assisting particles, blocking of the mesh occurs, and it becomes impossible to supply toner to the development sleeve.

SUMMARY OF THE INVENTION

In view of the aforementioned circumstances, an object of the present invention is to provide a compact and inexpensive developing device which is able to obtain the charging stability of a two-component development system while maintaining the structure of a one-component development system, and an image forming apparatus comprising such a developing device.

In order to achieve the aforementioned object, the developing device according to the present invention includes a container storing a two-component developer including a toner and a carrier, a toner carrying body carrying the toner in the container and supplying the toner to a predetermined image carrying body by rotation, a restricting member held in press contact with the toner carrying body, and a restricting nip section formed between the toner carrying body and the restricting member. The restricting nip section selects only the toner in the two-component developer to form a uniform toner layer on the toner carrying body.

These and other objects, features and advantages of the present invention will become more apparent upon reading of the following detailed description along with the accompanied drawings.

DETAILED DESCRIPTION OF THE PREFERRED EMBODIMENTS

Figure 1:
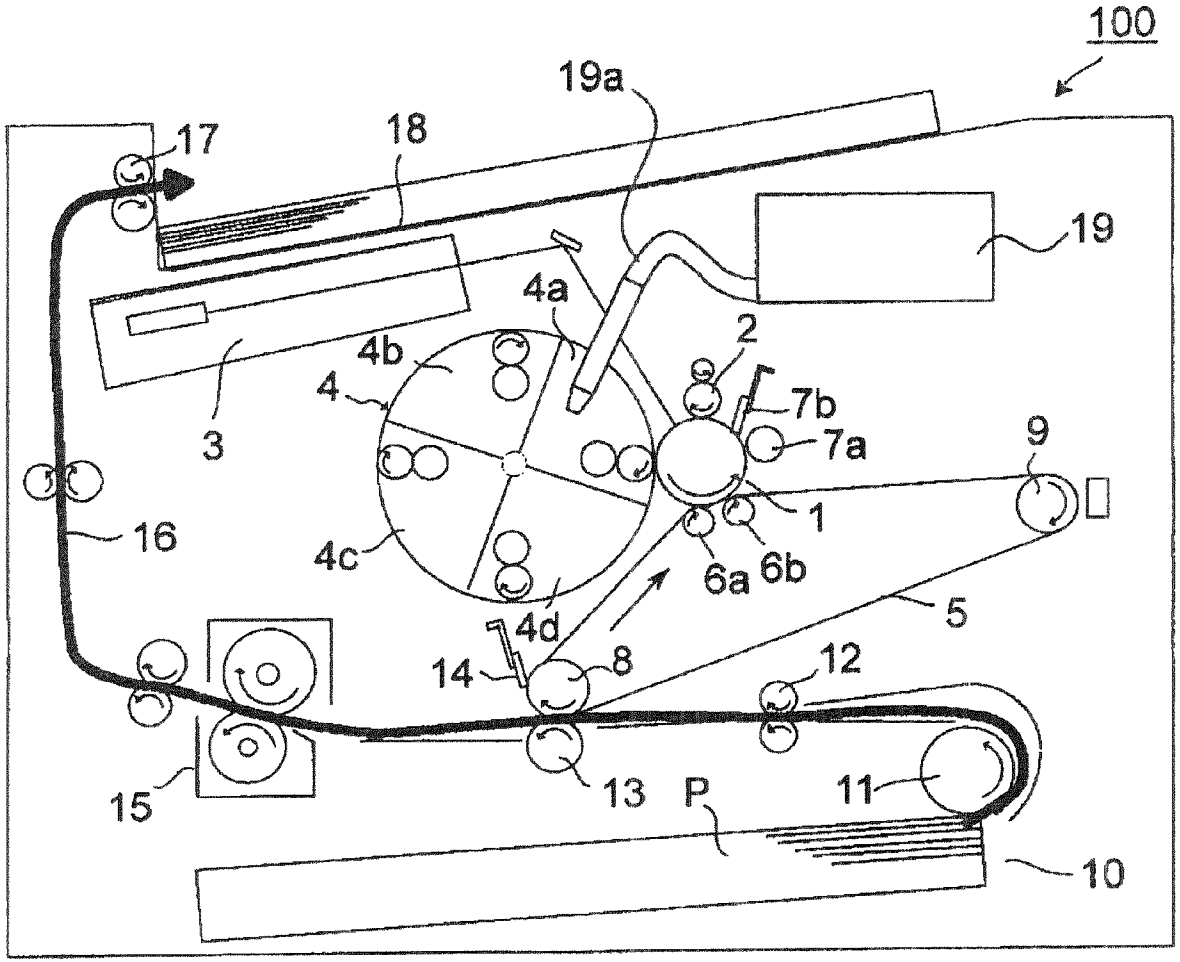
FIG. 1 is a side view in cross-section of a color image forming apparatus of a rotary type which includes a developing device according to the present invention.

An embodiment of the present invention will be described below with reference to the drawings. FIG. 1 is a general schematic diagram of a color image forming apparatus of a rotary development type which includes a developing device according to the present embodiment. In the image forming apparatus (here, a color printer) 100, when performing a copying operation, a photosensitive drum 1 which rotates in the counter-clockwise direction in FIG. 1 is charged uniformly by a charging unit 2 inside the main body of the apparatus. A laser beam is radiated from an exposure unit 3 onto the photosensitive drum 1 on the basis of original document image data which is input to the image input unit (not illustrated) from a personal computer, or the like, and an electrostatic latent image is thereby formed on the photosensitive drum 1.

The photosensitive drum 1 is, for example, constituted by an aluminum drum on which a photosensitive layer is laminated, and the surface is charged by the charging unit 2. An electrostatic latent image having attenuated charge is formed on the surface which has received the laser beam from the exposure unit 3. An amorphous silicon photosensitive body and an organic photosensitive body (OPC photosensitive body) are used as the photosensitive material which forms the photosensitive layer. If a positive OPC is used as the photosensitive layer, then little ozone or the like is produced, and charging is stable, in particular, in a positive OPC having a single-layer structure, even if the film thickness changes with use over a long period of time, there is no change in the photosensitive characteristics and image quality is also stable, which makes the material suitable for a system having a long lifespan.

A developing unit 4 of a rotary type which supplies the toner to the photosensitive drum 1 includes cartridge-type developing devices 4*a*, 4*b*, 4*c* and 4*d* of the respective colors of yellow, magenta, cyan and black, each of which has an integrated developing device and toner container. By successively rotating and moving the developing devices 4*a* to 4*d* to a position opposing the photosensitive drum 1, toner is caused to adhere to the electrostatic latent image on the photosensitive drum 1, thereby forming a toner image of the respective colors. The toner is supplied to the developing devices 4*a* to 4*d* from a toner container 19 which is coupled to a replenishment pipe 19*a*.

An intermediate transfer unit 5 onto which the toner image has been transferred is wrapped about intermediate transfer rollers 6*a* and 6*b*, a belt drive roller 8 and an idle roller 9, and is rotated in the clockwise direction in FIG. 1 by a drive device (which is not illustrated) while abutting against the photosensitive drum 1. A sheet made of a dielectric resin is used for the intermediate transfer belt 5, and may be used as a belt formed in an endless shape by mutually overlapping and bonding together respective ends of the sheet, or as a belt which does not have a joint (seamless belt).

When the user inputs the start of image formation, a yellow toner image is formed on the photosensitive drum 1 at a prescribed timing. The yellow toner image on the photosensitive drum 1 is transferred onto the intermediate transfer belt 5 by intermediate transfer rollers 6*a* and 6*b* to which a transfer bias of negative polarity (if using positively charged toner) has been applied (primary transfer). Thereupon, the toner remaining on the surface of the photosensitive drum 1 is removed by a cleaning roller 7*a* and a cleaning blade 7*b*, the developing unit 4 is then rotated by a prescribed amount (here, 90°), and similarly to the foregoing, a magenta toner image is formed on the photosensitive drum 1 and then transferred to the intermediate transfer belt 5.

Thereafter, cyan and black toner images are transferred from the photosensitive drum 1 onto the intermediate transfer belt 5 by means of a similar method to the foregoing. These images of four colors are formed with a predetermined positional relationship, in order to a form a predetermined full-color image. A transfer roller 13 is pressed against the intermediate transfer belt 5 at a position opposing the belt drive roller 8, and a belt cleaning blade 14 which removes residual toner from the surface of the intermediate transfer belt 5 is provided to the downstream side of the transfer roller 13.

A sheet of paper P is conveyed from a paper supply mechanism 10 via a paper supply roller 11 and a resist roller pair 12 toward the intermediate transfer belt 5 on which the toner images have been formed as described above, and the full-color toner image which has been formed successively on the surface of the intermediate transfer belt 5 is transferred in one action to the paper P by the transfer roller 13, to which a transfer bias of negative polarity has been applied (secondary transfer). The paper P to which the color toner image has been transferred is conveyed to a fixing device 15, where the toner image is fixed on the paper P. The sheet of paper P which has passed through the fixing device 15 is output to an output tray 18 via a paper conveyance path 16 and a pair of output rollers 17.

Figure 2:
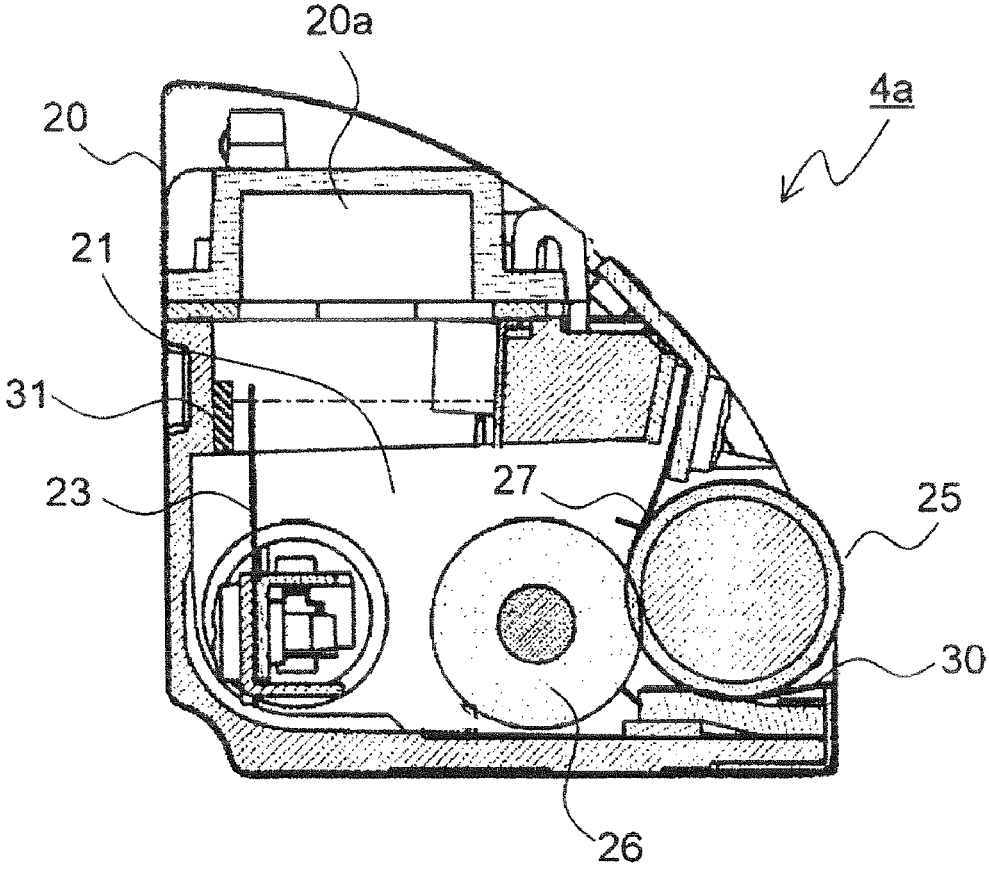
FIG. 2 is a side view in cross-section of the developing device according to a first embodiment of the present invention.
Figure 3:
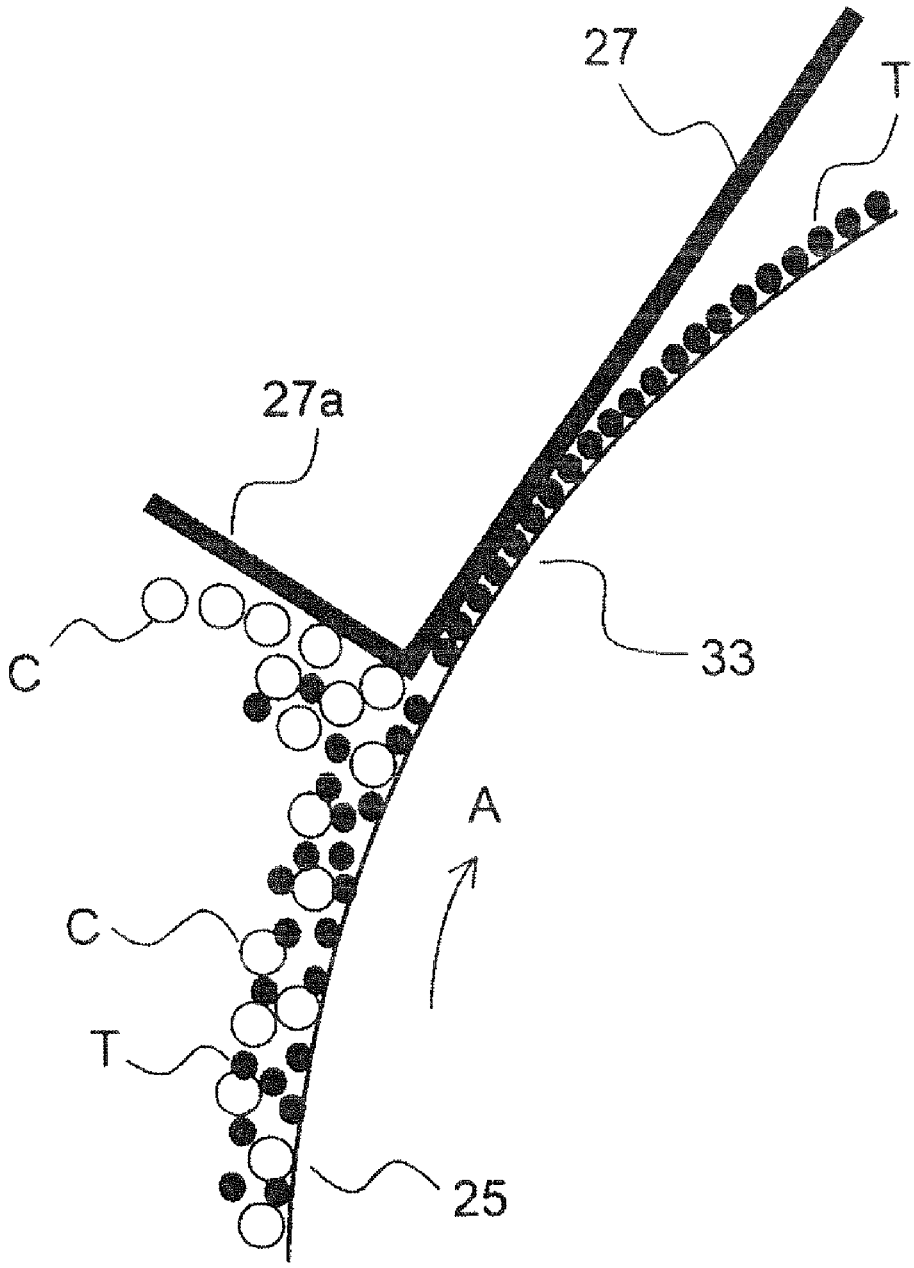
FIG. 3 is an enlarged schematic diagram showing a state of selecting between toner and carrier in a restricting nip section.

FIG. 2 is a side view in cross-section of the developing device according to a first embodiment of the present invention. FIG. 3 is an enlarged diagram of the vicinity of the nip section between the developing roller in FIG. 2 and the restricting member. In the description described below, the structure and the operation of a developing device 4*a* which corresponds to the photosensitive drum 1 in FIG. 1 is explained, but the structure and the operation of the developing devices 4*b* to 4*d* is essentially the same and therefore description thereof is omitted here.

The developing device 4*a* includes a developer container 20 made of resin which stores a two-component developer including a toner and a carrier. The developing device 4*a* includes inside the developer container 20, an agitating paddle 23 for mixing and agitating the two-component developer, a developing roller 25 which opposes the photosensitive drum (see FIG. 1), for developing the electrostatic latent image formed on the photosensitive drum 1, a supply roller 26 which rotates in the same direction as the developing roller 25 (the counter-clockwise direction) for supplying the developer to the developing roller 25 and wiping away residual toner from the developing roller 25, a metal restricting member 27 which is held in press contact with the developing roller 25, and a sealing member 30 which prevents leaking of the toner from the gap between the developing roller 25 and the developer container 20. The restricting member 27 is pressed against the developing roller 25 at the downstream side of the supply roller 26 with respect to the direction of rotation of the developing roller 25 (clockwise direction).

The agitating paddle 23 used is one in which an agitating blade, such as a PET film having a thickness of 40 μm, are attached to a rotating shaft, for example. In order further to improve the efficiency of mixing and agitation of the toner and the carrier, instead of an agitating paddle 23 as shown in FIG. 2, it is also possible to use a screw or fin type mixing and agitating member as used in a developing device based on a two-component development system.

For the developing roller 25, an elastic roller having a JIS-A hardness of 45 degrees, for example, a resistance of 1 E+6Ω and a surface roughness of Ra=1.0 μm is used. A urethane sponge roller having a resistance of 1 E+8Ω is used as the supply roller 26. The contact width (contact nip width) in the circumferential direction between the developing roller 25 and the supply roller 26 is set to 3 mm, for example.

For the restricting member 27, a stainless steel (SUS) foil of 0.08 mm thickness, for example, is used, and the restricting pressure against the developing roller 25 is set to 40 N/m. Furthermore, as shown in FIG. 3, the leading end of the restricting member 27 is pressed at a predetermined angle against the developing roller 25 while facing the upstream side with respect to the direction of rotation of the developing roller 25. The leading end of the restricting member 27 is bent back at a substantially perpendicular angle in the opposite direction with respect to the developing roller 25 to form a bended portion 27*a*. For the seal member 30, for example, a conductive high-polymer polyethylene film backed up with a urethane sponge so as to make uniform contact with the developing roller 25 is used.

The developer inside the developer container 20 is usually accommodated up to the level shown by the single-dotted line in FIG. 2. The ratio between the toner and the carrier in the developer is determined by a toner concentration sensor 31. For example, if a non-magnetic carrier which has optical transparency is used, then an optical sensor as the toner concentration sensor 31 is employed which utilizes a method of determining the concentration of toner in the developer by measuring the optical transparency. Instead of this, it is also possible to employ a method which determines the total amount of developer using a piezoelectric sensor as the toner concentration sensor 31 and then calculating the ratio of toner present in the developer assuming a uniform amount of carrier. Furthermore, if using a magnetic carrier, a magnetic permeability sensor which determines the change in the magnetic permeability with increase in the amount of toner is used.

For the toner employed in the developing device, it is possible to use a general toner manufactured by polymerization, crushing, or the like. Desirably, the toner has a volume-average particle size of 4 to 9 μm. For the carrier, it is possible to use a carrier which is used in a general two-component developer, such as iron powder, ferrite, resin carrier having magnetic powder dispersed in resin, or the like, but since there is no need to impart magnetic properties, then it is also possible to use a non-magnetic carrier, such as resin beads, or glass beads. Desirably, the average particle size of the carrier is approximately 20 to 200 μm.

To describe the development process by the developing device, the toner which is supplied from the toner supply port 20*a* is conveyed to the supply roller 26 as a two-component developer which is mixed and agitated with the carrier in the developer 20 by means of the agitating paddle 23 rotating the counter-clockwise direction in FIG. 2. The developer conveyed to the supply roller 26 is conveyed to the developing roller 25 by the supply roller 26 which rotates in the clockwise direction, and is further conveyed to a restricting nip section 33 which is formed between the developing roller 25 and the restricting member 27 by the developing roller 25 which rotates in the clockwise direction (the direction of arrow A in FIG. 3).

As shown in FIG. 3, the toner T and the carrier C in the developer are sorted or separated by gravity and particle size difference in the restricting nip section 33. The toner T which has a small particle size passes through the restricting nip section 33 and forms a thin layer of toner of a suitable quantity on the surface of the developing roller 25. On the other hand, the carrier C which has a large particle size and weight in comparison with the toner T cannot pass through the restricting nip section 33, and is moved away from the developing roller 25 along the bended portion 27*a* and returned in the direction of the supply roller 26.

The thin layer of toner formed on the surface of the developing roller 25 is conveyed to a development region thereof opposing the photosensitive drum 1 by the rotation of the developing roller 25 and is moved onto the photosensitive drum 1 due to the potential difference between the developing roller 25 and the photosensitive drum 1, thereby developing the electrostatic latent image on the photosensitive drum 1. The toner remaining on the developing roller 25 which has not been used for development is returned into the developer container 20 after passing through the seal member 30, and is then wiped away by the supply roller 26 and mixed and agitated again with the carrier in the developer container 20.

It is also possible to adopt a structure in which a partitioning wall which divides the interior of the developer container 20 is provided between the agitating paddle 23 and the supply roller 26, and to move the developer between a toner agitating section where the agitating paddle 23 is disposed and a toner supply section where the developing roller 25 and the supply roller 26 are disposed, via an opening formed in the partitioning wall. In this case, since insufficiently charged toner which has been newly supplied from the toner supply port 20*a* is charged sufficiently by mixing and agitating with the carrier in the toner agitating section, and is then conveyed to the toner supply section, it is possible to stabilize the charging of the toner and to form a uniform thin layer of toner on the developing roller 25.

Next, the state of contact between the developing roller 25 and the restricting member 27 will be described in detail with reference to FIGS. 4A and 4B. The restricting nip section 33 is a portion where the restricting member 27 and the developing roller 25 are held in contact, and the width of the restricting nip section 33 in the circumferential direction of the developing roller 25 is set to the restricting nip width L1. Furthermore, the distance from the bended portion 27*a* until the center C1 of the restricting nip width L1 is taken as the amount of projection L2.

Figure 4A:
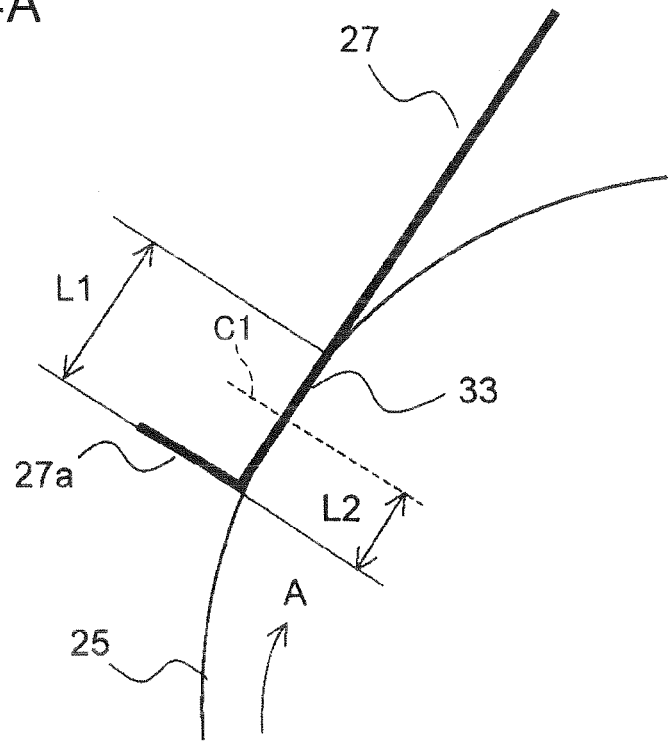
FIG. 4A is an enlarged diagram for explaining the state of contact between a restricting member and a developing roller in the restricting nip section.

In the present embodiment, in particular if using a non-magnetic carrier, the developing roller 25 and the restricting member 27 make contact in such a manner that the relationship 0.5 L1=L2 is established, as shown in FIG. 4A, in other words, in such a manner that the bended portion 27*a* assumes a state where it comes within the restricting nip width L1 (below, this is called "edge abutting"). As described below, if the contact between the developing roller 25 and the restricting member 27 in the restricting nip section 33 is an edge abutting state, then it is confirmed that the selection function between the toner and the non-magnetic carrier is extremely high. Furthermore, the bended portion 27*a* also performs the role of preventing damage to the developing roller 25 due to the pressing contact of the restricting member 27.

Figure 4B:
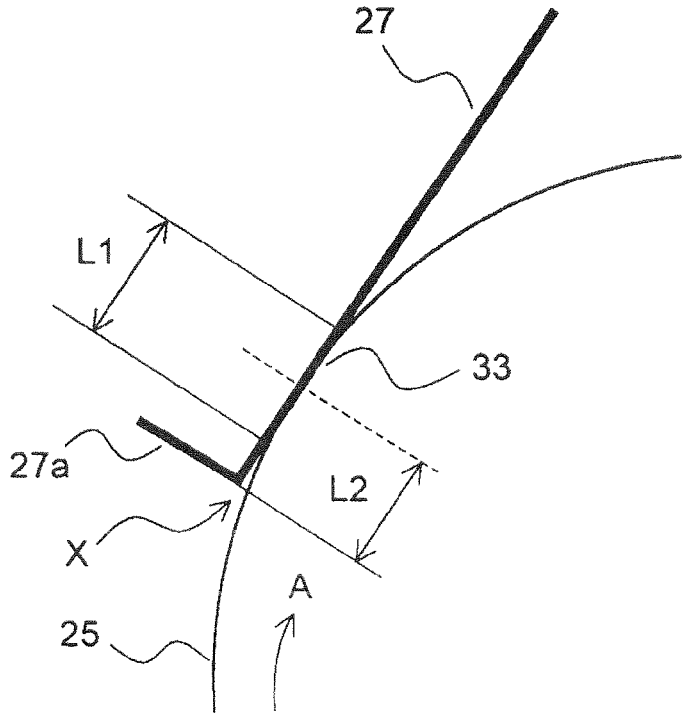
FIG. 4B is an enlarged diagram for explaining the state of contact between a restricting member and a developing roller in the restricting nip section.

If 0.5 L1<L2 as in FIG. 4B, then a wedge-shaped section X where there is no substantial contact between the developing roller 25 and the restricting member 27 is produced from the upstream end of the restricting nip width L1 with respect to the direction of rotation of the developing roller 25 (the direction of arrow A in FIG. 4B) until the bended portion 27*a*, and carrier of small diameter may enter into this wedge-shaped section X. The carrier that has entered into the wedge-shaped section X in this way pushes the restricting member 27 up due to the rotation of the developing roller 25, passes through the restricting nip section 33 and arrives at the development region, thereby creating a decline in the selection function. Desirably, the restricting nip width L1 is 4 mm or less and more desirably, 2 mm or less. Furthermore, desirably, the amount of projection L2 is restricted to 1 mm or less.

Moreover, if a non-magnetic carrier is used, then desirably, the circularity of the toner is 0.94 or greater, and the circularity of the carrier is less than 0.94. If the circularity of the toner is less than 0.94, then it is difficult for the toner to separate from the carrier in the restricting nip section 33 and form a uniform thin layer of toner, and if the circularity of the carrier is 0.94 or greater, then the carrier may pass through the restricting nip section 33. If the circularity of the toner is 0.96 or greater and if the circularity of the carrier is 0.90 or lower, then it is possible to form a uniform thin layer of toner over a longer period.

On the other hand, a magnetic carrier has a greater density than the non-magnetic carrier, and the selection by the restricting nip section 33 is relatively easy. Consequently, the contact conditions of the restricting member 27 with respect to the developing roller 25 do not have to be as strict as in the case of a non-magnetic carrier. If using a magnetic carrier, desirably, the amount of projection L2 is restricted to 1 mm or less.

If using a magnetic carrier, by installing a rubber magnet, or the like, on the surface of or in the vicinity of the restricting member 27, it is possible to raise the selection function between the carrier and the toner by the restricting nip section 33 and to remove the carrier which has become intermixed into the thin layer of toner by passing through the restricting nip section 33. Furthermore, it is also possible to improve the agitation efficiency by installing a rubber magnet, or the like, on the agitating blade of the agitating paddle 23. Moreover, if a thin layer of toner is formed on the developing roller 25 by using a non-magnetic toner, then in many cases it is difficult to achieve a toner seal about the periphery of the developing roller 25, but by creating a magnetic seal by disposing a magnetic member, such as a rubber magnet, in the vicinity of the seal member 30, then the sealing properties of the developer container 20 are enhanced markedly and it is possible to prevent leakage of toner effectively.

Moreover, by holding the magnetic carrier through imparting a magnetic force to the central portion (core) of the supply roller 26 and by bringing the developer which has formed a carrier chain into contact with the developing roller 25, the toner in the developer can be supplied preferentially to the developing roller 25 and furthermore the toner on the developing roller 25 which has not been used for development and which is returned to the developer container 20 can be scraped away efficiently. Moreover, since the developer is held by magnetic force, then it is possible to make the sponge holes of the supply roller 26 coarser, or to use a brush roller instead of a sponge roller. According to this structure, it is also possible to prevent stagnation of the toner inside the supply roller 26.

As the toner inside the developer container 20 is consumed and the ratio between the toner and the carrier in the developer changes, then the amount of charge on the toner also changes. The change in the amount of charge of the toner has a close relationship with the image quality. If the amount of charge declines, then image fogging becomes liable to occur, whereas if conversely the amount of charge becomes greater, then density non-uniformities become liable to occur. Therefore, the ratio between the toner and the carrier inside the developer container 20 is determined by the toner concentration detection sensor 31, and the toner replenishment amount from the toner container 19 (see FIG. 1) is controlled on the basis of the detection results, similarly to a two-component development method. Accordingly, it is possible to maintain a constant ratio between the toner and the carrier in the developer, and the toner can be charged in a stable fashion.

The desirable mixture ratio of the toner and the carrier varies with the type of toner and carrier, but is generally controlled in such a manner that the ratio of the toner is approximately 5 to 20%. Furthermore, it is also possible to replenish toner in accordance with the total amount of developer in the developer container 20, without using the toner concentration detection sensor 31.

Figure 5:
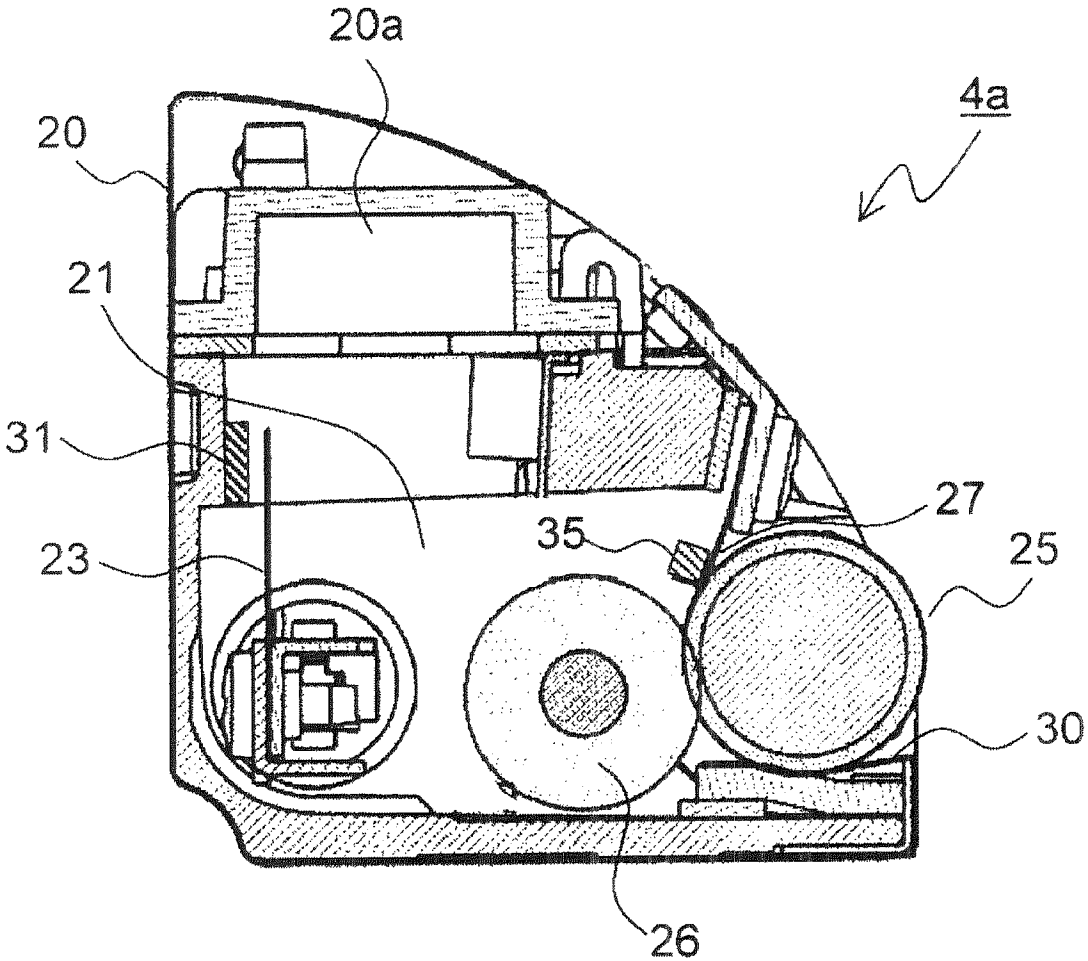
FIG. 5 is a side view in cross-section of the developing device according to a second embodiment of the present invention.
Figure 6:
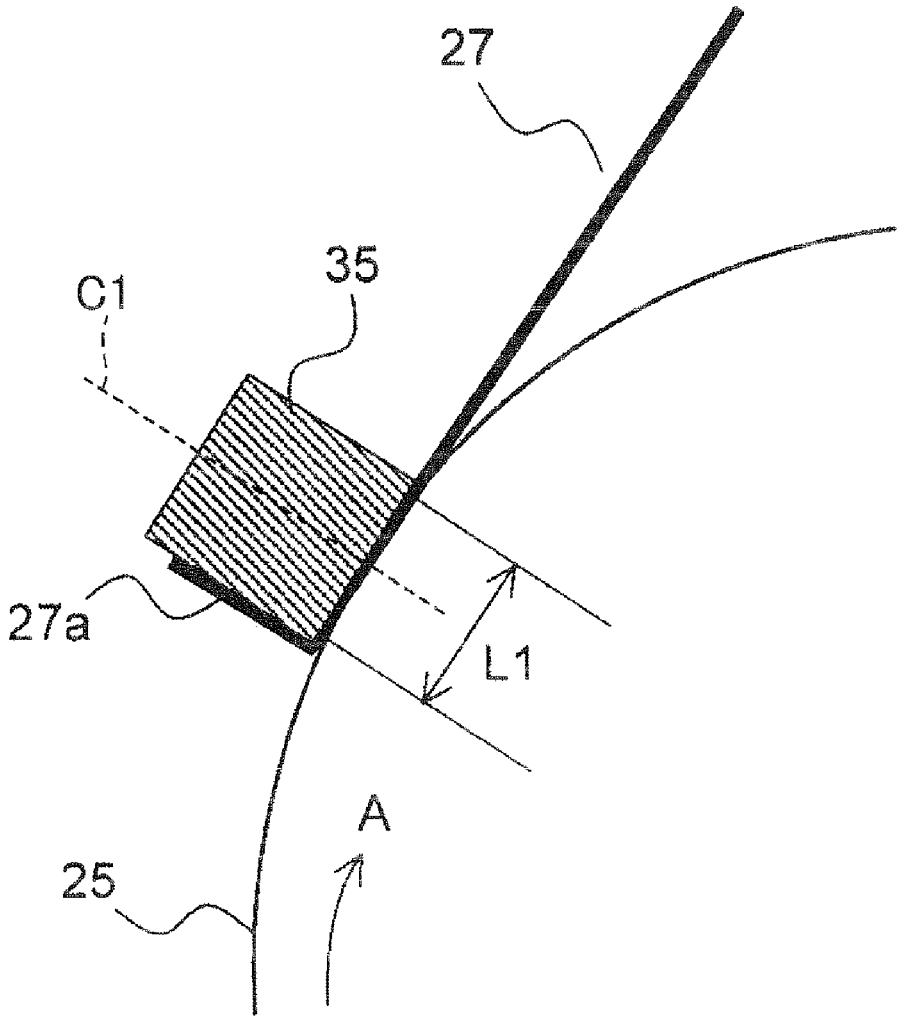
FIG. 6 is a partial enlarged diagram of the vicinity of the restricting nip section in FIG. 5.

FIG. 5 is a side view in cross-section of the developing device according to a second embodiment of the present invention, and FIG. 6 is an enlarged diagram of the vicinity of the nip section between a developing roller and a restricting member in FIG. 5. In the present embodiment, a two-component developer including a non-magnetic toner and a magnetic carrier is used, and a magnetic member 35 is attached to the leading end of the restricting member 27. The structure and material of the respective member in the developing device are the same as those of the first embodiment which is shown in FIG. 2 and FIG. 3, and therefore description thereof is omitted here.

As shown in FIG. 6, a magnet member 35 is fixed to the restricting member 27 throughout the whole of the lengthwise direction (direction of the sheet surface of FIG. 6), on the inner side of the bended portion 27*a*, and is disposed in such a manner that it projects to the upstream side from the center C1 of the restricting nip width L1, with respect to the direction of rotation of the developing roller 25 (the direction of arrow A). By this means, the magnetic carrier in the developer which is conveyed by the rotation of the developing roller 25 is attracted by the magnetic force of the magnet member 35 in the bended portion 27*a*, and is thereby prevented from advancing to the restricting nip section 33. Consequently, it is also possible further to improve the toner and carrier selection function of the restricting nip section 33.

In FIG. 6, the magnet member 35 is fixed to the inner side of the bended portion 27*a*, but it may also be fixed to the outer side of the bended portion 27*a*. In this case, desirably, the magnet member 35 does not enter into the restricting nip section 33. Furthermore, in the present embodiment, the upstream side surface of the magnet member 35 serves as the bended portion 27*a* and therefore the selection function between the toner and the carrier does not decline, even if the bended portion 27*a* is not provided on the restricting member 27. However, it is desirable to provide the bended portion 27*a* in order to prevent scratching of the developing roller 25.

Apart from this, the present invention is not limited to the embodiments described above, and may be modified within a scope that does not depart from the essence of the present invention. For instance, the shape, material, dimensions, and the like of the respective members indicated in the respective embodiments described above are examples, and may be altered as appropriate in accordance with the specifications of the developing device. Furthermore, the present invention is not limited to a color printer of a rotary type as shown in FIG. 1, and can also be applied suitably to image forming apparatuses of various types, such as a digital or analogue monochrome or color copying machine, facsimile machine, or the like. Below, the beneficial effects of the present invention are described in further detail by means of practical examples.

Practical Example 1

The relationship between the average circularity of the toner and carrier, the contact conditions of the restricting member and the thin layer of toner formed on the developing roller, when using the developing device according to the present invention, was investigated. The test method employed a test machine in which a developing device such as that shown in FIG. 2 was mounted, and test images having a coverage rate of 5% were printed consecutively while altering the average circularities of the toner and the carrier and the contact conditions of the restricting member. After printing a predetermined number of copies, the state of the thin layer of toner on the developing roller was observed visually.

<Method of Manufacturing Toner>

60 parts by weight of polyester A (L body; number-average molecular weight: 4,300; weight-average molecular weight: 9,800; Tg=58° C., Tm=102° C.), 40 parts by weight of polyester B (H body; number-average molecular weight: 2,500; weight-average molecular weight: 200,000; Tg=60° C.; Tm=130° C.), 3 parts by weight of Fischer-Tropsch wax (made by Nippon Seiro, Co., Ltd.), and 5 parts by weight of carbon black (Pr-90, made by Cabot Corp.) were mixed together in a Henschel mixer, and then melted and kneaded at 130° C. in a dual-axle extruder, to prepare a resin composition for toner particles.

The resin composition for toner particles thus obtained was crushed in a crushing machine (IDS-2, made by Nippon Pneumatic Mfg. Co., Ltd.) and classified by an air classifier apparatus (Alpine classifier made by Alpine Co., Ltd.). Thereupon, the material was spheronized under conditions of approximately 7,000 rpm in a Hosokawa Micron F-40 spheronizer, to obtain positively charged toner particles having a volume-average particle size of 6.8 μm and an average circularity of 0.945. Moreover, by altering the rotational speed of the spheronizer, positively charged toner particles having an average circularity of 0.926 were obtained.

On the other hand, spheronization was carried out under conditions of approximately 8,000 rpm in a Hosokawa Micron F-40 spheronizer, and further spheronization was carried out at 8,000 rpm using an NHS-1 hybridizer system made by Nara Machinery Co., Ltd., to obtain positively charged toner particles having a volume-average particle size of 6.8 μm and an average circularity of 0.960.

The volume-average particle size of the toner was measured in a measurement range of 2.0 to 60 μm using a particle size analyzer (Beckman Coulter Multisizer III with aperture diameter of 100 μm), and the average circularity of the toner was measured with a Sysmex FPIA-2100 flow type particle image analyzer. The measurement method employed involved obtaining a projected image of toner particles and then calculating the length of perimeter (La) and the projected surface area (S) of the projected images of the toner particles A. Here, if the length of perimeter of a circle of surface area (S) is taken as Ls, then the circularity is expressed as Ls/La, and by averaging this circularity for all of the particles in the projected image, the average circularity of the toner particles A is calculated.

<Method of Manufacturing Non-Magnetic Carrier>

100 parts by weight of styrene—acrylic copolymer and 5 parts by weight of carbon were mixed in a Henschel mixer. This mixture was melted and kneaded in a dual-axle kneading machine (cylinder temperature 170° C.), and then crushed and classified, thereby producing non-magnetic carrier particles having a weight-average particle size of 50 μm.

<Method of Manufacturing Magnetic Carrier>

1,000 parts by weight of a carrier core material (spherical ferrite particles, weight-average particle size 50 μm) was coated with a resin liquid by immersion, using a resin liquid of 10 parts by weight of methyl silicone resin (Shin'etsu Silicone KR-251) diluted in 500 parts by weight of toluene. Thereupon, the carrier core material coated with resin liquid was heat treated using a heat treatment apparatus (Nippon Pneumatic suffusion system). In this, the heat treatment temperature and the heat treatment time were adjusted and the circularity of the carrier was controlled. Thereupon, the carrier was classified by air flow classification to yield magnetic carrier having a weight-average particle size of 50 μm.

The average circularity of the carrier is defined as (length of perimeter of circle having same surface area as the projected surface area of the particle)/(length of perimeter of projected image); 100 carrier images magnified 100 to 300 times were sampled at random using a scanning electron microscope (FE-SEM) (Hitachi S-800) and were measured using an image analyzer (Nireco Corp. Luzex III) via an interface. The weight-average particle size of the carrier was also measured using the same equipment.

The toner and non-magnetic carrier or magnetic carrier manufactured by the method described above was mixed in a toner to carrier ratio (T/C) of 8% to obtain a two-component developer. Furthermore, the restricting nip width L1 was taken to be 0.5 mm, and the amount of projection L2 was taken to be 0.25 mm (if 0.5 L1=L2) and 0.5 mm (if 0.5 L1<L2). The test results are shown in Table 1. In Table 1, a ⊗evaluation was given if no disturbance of the thin layer of toner occurred at all, a ○ evaluation was given is virtually no such disturbance occurred, a Δ evaluation was given if slight disturbance occurred, and a x evaluation was given if marked disturbance occurred.

TABLE 1

| | Carrier | Average circularity | | Relationship | Thin layer of toner | | |
|---|---|---|---|---|---|---|---|
| | type | Toner | Carrier | L1 & L2 | At start | After printing 10K | After printing 50K |
| Invention 1 | Non-magnetic | 0.96 | 0.9 | 0.5 L1 = L2 | ⊗ | ⊗ | ⊗ |
| Invention 2 | Non-magnetic | 0.945 | 0.9 | 0.5 L1 = L2 | ⊗ | ⊗ | ○ |
| Invention 3 | Non-magnetic | 0.945 | 0.935 | 0.5 L1 = L2 | ⊗ | ○ | ○ |

TABLE 1-continued

| | Carrier type | Average circularity Toner | Average circularity Carrier | Relationship L1 & L2 | Thin layer of toner At start | Thin layer of toner After printing 10K | Thin layer of toner After printing 50K |
|---|---|---|---|---|---|---|---|
| Invention 4 | Magnetic | 0.945 | 0.9 | 0.5 L1 < L2 | ⊗ | ⊗ | ⊗ |
| Invention 5 | Magnetic | 0.926 | 0.95 | 0.5 L1 < L2 | ⊗ | ○ | ○ |
| Comparative Example 1 | Non-magnetic | 0.926 | 0.935 | 0.5 L1 = L2 | Δ | x | x |
| Comparative Example 2 | Non-magnetic | 0.945 | 0.95 | 0.5 L1 = L2 | Δ | x | x |
| Comparative Example 3 | Non-magnetic | 0.945 | 0.935 | 0.5 L1 < L2 | x | x | x |

As can be seen from Table 1, if a non-magnetic carrier is used, then in Inventions 1 to 3 where the average circularity of the toner is 0.94 or greater, the average circularity of the carrier is less than 0.94, and ½ of the restricting nip width L1 is equal to the amount of projection L2, it was possible to form a uniform thin layer of toner on the developing roller even after printing 50,000 sheets. Furthermore, in a comparison of the Inventions 1 to 3, the disturbance of the thin layer of toner was increasingly suppressed, in the order of Invention 1, Invention 2 and Invention 3, as the average circularity of the toner became higher and the average circularity of the carrier became lower.

In contrast, in Comparative Example 1 in which the average circularity of the toner is less than 0.94 and in Comparative Example 2 in which the average circularity of the carrier is 0.94 or greater, slight disturbance occurred in the thin layer of toner from the start of printing, and the disturbance of the thin layer of toner became marked after printing 10,000 sheets. Furthermore, in Comparative Example 3 where the restricting nip width L1 is smaller than two times the amount of projection L2, marked disturbance of the thin layer of toner occurred from the start of printing, regardless of the fact that the average circularity of the toner was equal to or greater than 0.94 and that the average circularity of the carrier was less than 0.94.

On the other hand, in Inventions 4 and 5 which used a magnetic carrier, it was possible to form a uniform thin layer of toner on the developing roller, even after printing 50,000 sheets, regardless of the fact that ½ of the restricting nip width L1 was smaller than the amount of projection L2. Furthermore, in a comparison of the Inventions 4 and 5, the disturbance of the thin layer of toner was suppressed to a greater extent in the Invention 4 which had a higher average circularity of the toner and a lower average circularity of the carrier than in Invention 5. This is thought to be because the magnetic carrier has a higher density than the non-magnetic carrier, and therefore can be separated more readily from the toner in the restricting nip section 33.

Practical Example 2

The relationship between the mixture ratio of the toner and carrier and the amount of charge of the thin layer of toner formed on the developing roller, when using the developing device according to the present invention, was investigated. The test method involved forming a thin layer of toner on the developing roller immediately after start up of the apparatus, while altering the mixture ratio (T/C) of the toner and the non-magnetic or magnetic carrier in the two-component developer, using the same test machine as the first embodiment, and measuring the amount of charge on the toner per unit weight (Q/M) with a Trek QM meter.

Figure 7:
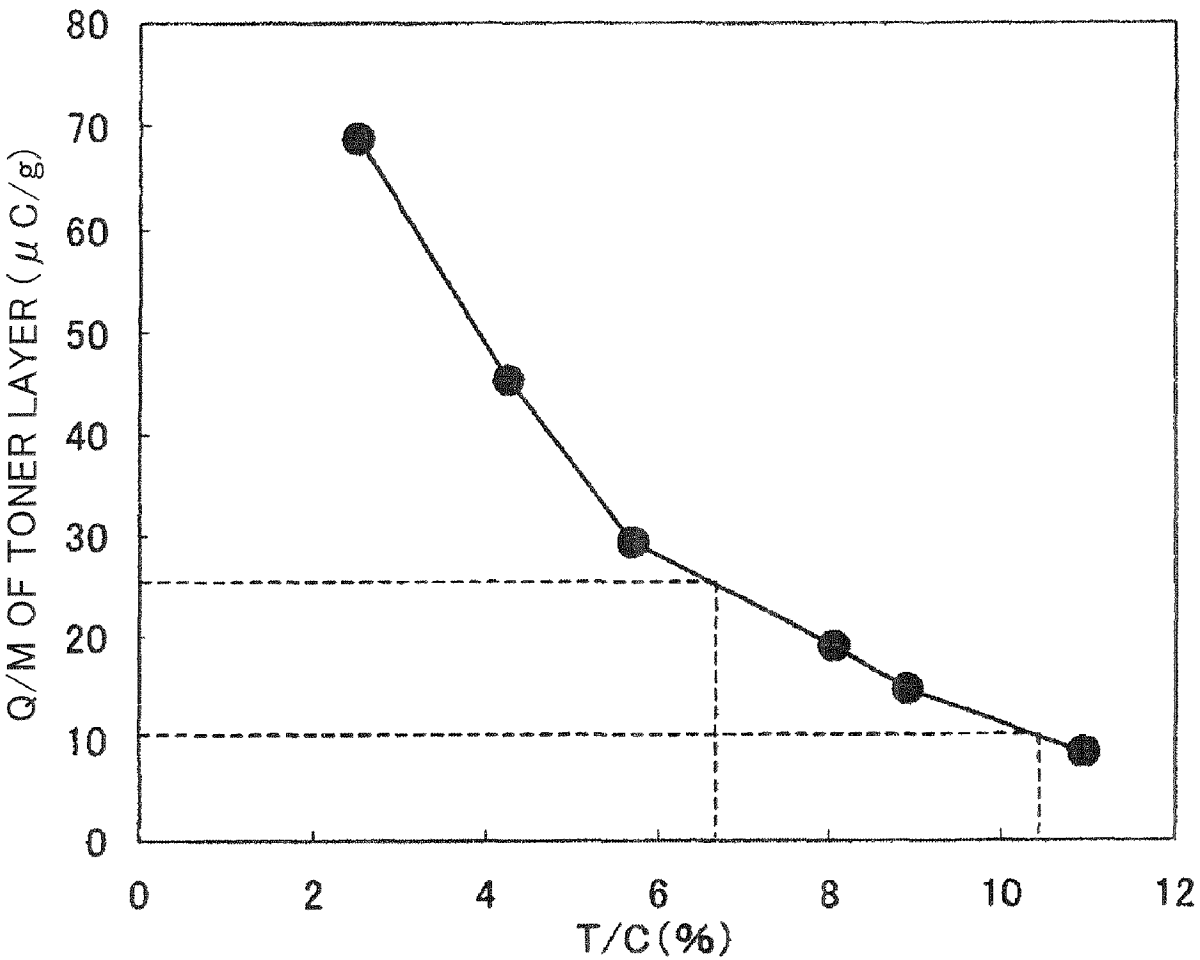
FIG. 7 is a graph showing the relationship between the mixture ratio of toner and a non-magnetic carrier and the amount of charge of the toner on the developing roller.

For the toner, a positively charged toner having a volume-average particle size of 6.8 μm and average circularity of 0.945 as employed in Practical Example 1 was used, and for the carrier, a non-magnetic carrier and a magnetic carrier having a weight-average particle size of 50 μm and an average circularity of 0.9 as employed in the first embodiment was used. Furthermore, the restricting nip width L1 was set to 0.5 mm and the amount of projection L2 was set to 0.25 mm (0.5 L1=L2). FIG. 7 shows the results of a case where a non-magnetic carrier was used and FIG. 8 shows the results of a case where a magnetic carrier was used.

Figure 8:
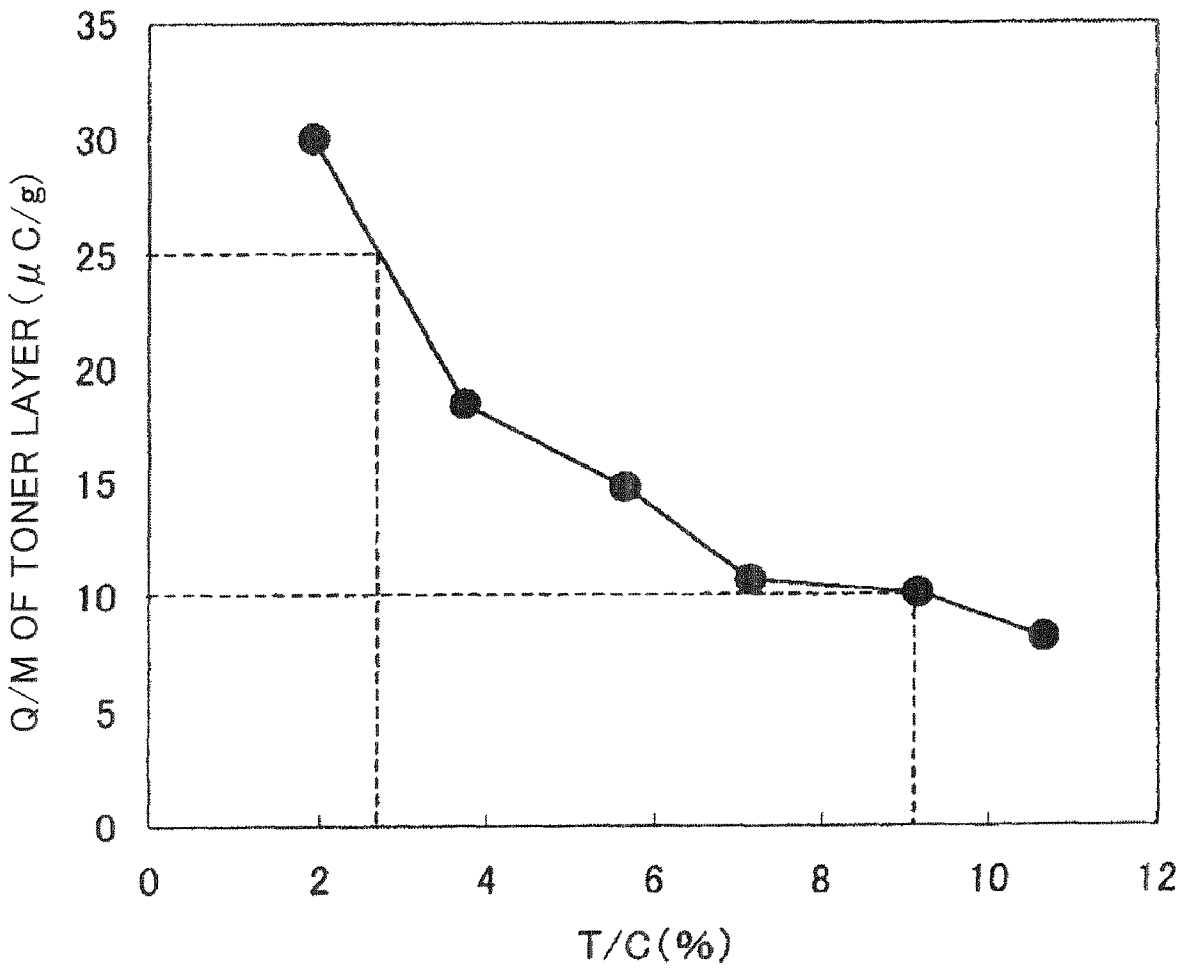
FIG. 8 is a graph showing the relationship between the mixture ratio of toner and a magnetic carrier and the amount of charge of the toner on the developing roller.

As FIG. 7 and FIG. 8 reveal, in both the case of using a non-magnetic carrier and a magnetic carrier, the Q/M value becomes smaller as the T/C ratio in the developing device increases. The Q/M value is closely related to image quality, and it is known that if Q/M becomes greater than 25 μC/g, then density non-uniformities occur, while if Q/M is less than 10 μC/g, then image fogging occurs. Consequently, it was confirmed that by controlling the replenishment of toner in such a manner that the T/C ratio is kept to 7 to 10% when using a non-magnetic carrier, and 3 to 9% when using a magnetic carrier, the Q/M value is kept in the range of 10 to 25 μC/g and image defects can be suppressed.

The test conditions of the Examples described above are no more than examples, and it is known that similar beneficial results are obtained with toners manufactured by an emulsification and polymerization method, or a pulverization method, and carriers of other types, for instance.

The developing device according to the present embodiments which was described above preferably has the structure mentioned below.

The developing device preferably includes a container storing a two-component developer including a toner and a carrier, a toner carrying body carrying the toner in the container and supplying the toner to a predetermined image carrying body by rotation, a restricting member held in press contact with the toner carrying body, and a restricting nip section formed between the toner carrying body and the restricting member. The restricting nip section selects only the toner in the two-component developer to form a uniform toner layer on the toner carrying body.

According to the developing device having the structure described above, only the toner of the two-component developer is selected in the restricting nip section to form a uniform thin layer of toner on the toner carrying body, it is possible to obtain stable toner charging similar to that of a two-component development system, while maintaining the simple structure of a one-component development system.

In the developing device having the structure described above, the restricting member preferably has a leading end that is held in press contact with the toner carrying body while facing upstream with respect to the direction of rotation of the toner carrying body.

According to the structure described above, by pressing the leading end of the restricting member toward the upstream side in the direction of rotation of the toner carrying body, it is possible to suppress ingress of carrier into the restricting nip section and therefore to improve the performance in selecting between the toner and the carrier.

Furthermore, in the developing device having the structure described above, the leading end of the restricting member is preferably bent on the side opposite to the toner carrying body with respect to the restricting nip section.

According to the structure described above, since the leading end of the restricting member is bend on the side opposite to the toner carrying body with respect to the restricting nip section, it is possible for the carrier, which has not been able to enter into the restricting nip section, to move in a direction away from the toner carrying body, along the bended portion. Furthermore, it is also possible to prevent scratching of the toner carrying body due to pressure contact by the restricting member.

Furthermore, in the developing device having the structure described above, the toner is a non-magnetic toner and the carrier is a magnetic carrier.

According to the structure described above, by using a two-component developer including a non-magnetic toner and a magnetic carrier, it is easy to select the non-magnetic toner from the magnetic carrier of high density in the restricting nip section. Furthermore, it is also possible to remove the magnetic carrier mixed in the thin layer of toner by disposing a magnetic member in the vicinity of the toner carrying body, and the agitating performance or the sealing performance can be improved by the resulting magnetic force.

Moreover, in the developing device having the structure described above, the toner carrying body is a roller member, and the leading end of the restricting member is preferably provided with a magnet member extending upstream, with respect to the direction of rotation of the toner carrying body, beyond a center of the restricting nip section in a circumferential direction of the toner carrying body.

According to the structure described above, by providing with the leading end of the restricting member a magnet member projecting upstream in the rotation direction of the toner carrying body beyond the center of the restricting nip section in the circumferential direction of the toner carrying body, the magnetic carrier is attracted by the magnetic force of the magnet member and is restricted from entering into the restricting nip section, thus making it possible further to improve the performance in separating the toner and the carrier in the restricting nip section.

Furthermore, in the developing device having the structure described above, the magnet member has an upstream-side surface facing upstream with respect to the rotation direction and extending on the side opposite to the toner carrying body with respect to the leading end.

According to this structure, the upstream-side surface of the magnet member serves the role of the bended portion of the restricting member, the performance in separating the toner and the carrier in the restricting nip section does not decrease even without the bended portion of the restricting member.

Moreover, in the developing device having the structure described above, the toner is a non-magnetic toner, the carrier is a non-magnetic carrier, and the toner carrying body is a roller member, and when a width of the restricting nip section in a circumferential direction of the toner carrying body is expressed as L1 and the distance between a center of the restricting nip section in the circumferential direction and the leading end of the restricting member is expressed as L2, the width L1 and the distance L2 are set so as to satisfy 0.5 L1=L2.

According to the structure described above, by setting the relationship 0.5 L1=L2 between the width L1 of the restricting nip section in the circumferential direction of the toner carrying body and the distance L2 from the leading end of the restricting member until the center of the restricting nip section, it is possible to improve the selection performance of the restricting nip section in cases where a non-magnetic carrier is used.

Moreover, in the developing device having the structure described above, it is preferable that the average circularity of the toner is 0.94 or greater and the average circularity of the carrier is less than 0.94.

According to the structure described above, since the circularity of the toner is set to 0.94 or greater, then the toner is readily separated from the carrier in the restricting nip section, and consequently, a uniform thin layer of toner is readily formed on the toner carrying body. Furthermore, since the circularity of the carrier is set to less than 0.94, then the carrier is restricted from passing through the restricting nip section, and consequently the carrier is restricted from becoming mixed into the thin layer of toner.

Moreover, in the developing device having the structure described above, it is more preferable that the average circularity of the toner is 0.96 or greater and the average circularity of the carrier is 0.90 or less.

According to this structure, since the circularity of the toner is 0.96 or greater and the circularity of the carrier is 0.90 or less, then it is possible to maintain the selection performance when using a non-magnetic carrier, over a long period of time, and consequently it is possible to form a uniform thin layer of toner over a longer period of time.

Moreover, in the developing device having the structure described above, the developing device preferably further includes a detection sensor detecting the ratio of the toner relative to the carrier in the container, and the toner is replenished on the basis of the detection result of the detection sensor to keep the ratio constant.

According to this structure, by determining the ratio of the toner relative to the carrier inside the container and by replenishing the toner in such a manner that the ratio of the toner relative to the carrier is kept constant on the basis of the detection result, it is possible to charge the toner in a stable fashion over a long period of time, and therefore decline in image quality due to image fogging, density non-uniformities, or the like, can be suppressed effectively.

The developing device having the structure described above is preferably installed in an image forming apparatus. By this means, the image forming apparatus can suppress image fogging, density non-uniformities, toner supply defects, and the like, caused by toner charging failure.

This application is based on Japanese patent application serial No. 2008-185649, filed in Japan Patent Office on Jul. 17, 2008, the contents of which is hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device comprising:

a container storing a two-component developer including a toner and a carrier, the toner being a non-magnetic toner and the carrier being a non-magnetic carrier;

a toner carrying roller carrying the toner in the container and supplying the toner to a predetermined image carrying body by rotation;

a restricting member held in press contact with the toner carrying roller; and a restricting nip section formed between the toner carrying roller and the restricting member, the restricting nip section having a width in a circumferential direction of the toner carrying roller that is expressed as L1 and a distance between a center of the restricting nip section in the circumferential direction and the leading end of the restricting member being expressed as L2, the width L1 and the distance L2 being set to satisfy 0.5 L1=L2;

wherein the restricting nip section selects only the toner in the two-component developer to form a uniform toner layer on the toner carrying roller.

2. The developing device according to claim 1, wherein the restricting member has a leading end that is held in press contact with the toner carrying roller while facing upstream with respect to the direction of rotation of the toner carrying roller.

3. The developing device according to claim 2, wherein the leading end of the restricting member is bent on the side opposite to the toner carrying roller with respect to the restricting nip section.

4. The developing device according to claim 2, wherein the leading end of the restricting member is provided with a magnet member extending upstream, with respect to the direction of rotation of the toner carrying roller, beyond a center of the restricting nip section in a circumferential direction of the toner carrying roller.

5. The developing device according to claim 4, wherein the magnet member has an upstream-side surface facing upstream with respect to the rotation direction and extending on the side opposite to the toner carrying roller with respect to the leading end.

6. The developing device according to claim 1, wherein the average circularity of the toner is 0.94 or greater and the average circularity of the carrier is less than 0.94.

7. The developing device according to claim 6, wherein the average circularity of the toner is 0.96 or greater and the average circularity of the carrier is 0.90 or less.

8. The developing device according to claim 1, further comprising a detection sensor detecting the ratio of the toner relative to the carrier in the container, wherein the toner is replenished on the basis of the detection result of the detection sensor to keep the ratio constant.

9. An image forming apparatus, comprising:

a photosensitive drum on which an electrostatic latent image is formed on the basis of image data from an external source;

a developing device supplying toner to the photosensitive drum to form a toner image on the basis of the electrostatic latent image;

a transfer unit transferring the toner image on the photosensitive drum to a paper; and a fixing unit fixing the toner image on the paper, the developing device including:

a container storing a two-component developer including a toner and a carrier, the toner being a non-magnetic toner and the carrier being a non-magnetic carrier;

a toner carrying roller carrying the toner in the container and supplying the toner to a predetermined image carrying body by rotation;

a restricting member held in press contact with the toner carrying roller; and a restricting nip section formed between the toner carrying roller and the restricting member, the restricting nip section having a width in a circumferential direction of the toner carrying roller that is expressed as L1 and a distance between a center of the restricting nip section in the circumferential direction and the leading end of the restricting member being expressed as L2, the width L1 and the distance L2 being set to satisfy 0.5 L1=L2;

wherein the restricting nip section selects only the toner in the two-component developer to form a uniform toner layer on the toner carrying body.

10. The image forming apparatus according to claim 9, wherein the restricting member has a leading end that is held in press contact with the toner carrying roller while facing upstream with respect to the direction of rotation of the toner carrying roller.

11. The image forming apparatus according to claim 10, wherein the leading end of the restricting member is bent on the side opposite to the toner carrying roller with respect to the restricting nip section.

12. The image forming apparatus according to claim 10, wherein the leading end of the restricting member is provided with a magnet member extending upstream, with respect to the direction of rotation of the toner carrying roller, beyond the center of the restricting nip section in a circumferential direction of the toner carrying roller.

13. The image forming apparatus according to claim 12, wherein the magnet member has an upstream-side surface facing upstream with respect to the rotation direction and extending on the side opposite to the toner carrying roller with respect to the leading end.

14. The image forming apparatus according to claim 9, wherein the average circularity of the toner is 0.94 or greater and the average circularity of the carrier is less than 0.94.

15. The image forming apparatus according to claim 14, wherein the average circularity of the toner is 0.96 or greater and the average circularity of the carrier is 0.90 or less.

16. The image forming apparatus according to claim 11, further comprising a detection sensor detecting the ratio of the toner relative to the carrier in the container, wherein the toner is replenished on the basis of the detection result of the detection sensor to keep the ratio constant.

* * * * *